US006319047B1

(12) United States Patent
Kang

(10) Patent No.: US 6,319,047 B1
(45) Date of Patent: Nov. 20, 2001

(54) IDC ADAPTER

(75) Inventor: Yung-Ho Kang, Taipei (TW)

(73) Assignee: Yu-Ho Liang, Taipei Hsien (TW)

( * ) Notice: Subject to any disclaimer, the term of this patent is extended or adjusted under 35 U.S.C. 154(b) by 0 days.

(21) Appl. No.: 09/793,628

(22) Filed: Feb. 27, 2001

(51) Int. Cl.[7] ..... H01R 4/24
(52) U.S. Cl. ..... 439/404; 439/417; 439/676
(58) Field of Search ..... 439/404, 76.1, 439/676, 417

(56) References Cited

U.S. PATENT DOCUMENTS 5,091,826 * 2/1992 Arnett et al. ..... 439/404
5,228,872 * 7/1993 Liu ..... 439/404
5,905,637 * 5/1999 Su ..... 439/676
5,947,752 * 9/1999 Wu ..... 439/76.1
6,135,821 * 10/2000 Liu ..... 439/676

* cited by examiner

*Primary Examiner*—Renee Luebke
*Assistant Examiner*—Briggitte Hammond
(74) *Attorney, Agent, or Firm*—Bacon & Thomas, PLLC

(57) ABSTRACT

An insulation displacement connector type adapter has a housing, a circuit board, two IDCs received in the housing and a cover to enclose the IDCs inside the housing. The two IDCs are vertical with respect to the circuit when the two IDCs are securely engaged with the circuit board, such that the center of gravity of the adapter falls within an area covered by the housing.

7 Claims, 6 Drawing Sheets

IDC ADAPTER

BACKGROUND OF THE INVENTION

1. Field of the Invention

The present invention relates to an insulation displacement connector (IDC) type adapter, and more particularly to a adapter having a circuit board laterally located inside the housing so that the structures of two IDCs are able to correspond to each other and the adapter is able to keep its balance when the tool is applied to communicate the terminals on each of the IDCs with the circuit board.

2. Description of Related Art

With reference to U.S. Pat. No. 5,228,872 issued to Danny Liu et al on Jul. 20, 1993 and FIGS. 5 and 6, the conventional IDC adapter has a housing (9), two sets of IDCs (92,921) securely mounted on a seat inside the housing (9) and a circuit board (91). The IDCs (92,921) are overlapped on top of the circuit board (91) so that a tool (99) is able to be implemented to communicate the terminals (93,931) on the IDCs (92,921) with the circuit board (91).

With such an IDC adapter, a user does have the function of connection and communication in various applications. However, the conventional adapter encounters several disadvantages:

With reference to FIG. 5, because the circuit board (91) is mounted on a side of the housing (9), such that after the installation of the IDCs (92,921) on top of the circuit board (91), the center of gravity of the assembly is shifted. That is, the two IDCs (92,921) are offset in relation to the housing (9). Especially, the outermost IDC (921) is far away from the center line of the housing (9) and thus a distance D exists between the IDC (921) and the center line of the housing (9). When the tool (99) is applied to puncture the wires (98) to make communication between the terminals (93,931) and the circuit board (91), the adapter might just fall and therefore causes injury to the operator by the tool (99).

Communication between the two IDCs (92,921) and the circuit board (91) is necessary and each of the two IDCs (92,921) has 5 different terminals (93,931) to be connected with the circuit board (91). When connecting the terminals (93,931) to the circuit board (91), each terminals (93,931) needs to be bent, which is quite troublesome.

Furthermore, due to the distance between each of the IDCs (92,921) to the circuit board (91) is different from each other, manufacturer needs to produce different IDCs (92, 921) for application and spare parts as well.

To overcome the shortcomings, the present invention intends to provide an improved IDC adapter to mitigate or obviate the aforementioned problems.

SUMMARY OF THE INVENTION

The primary objective of the invention is to provide an PDC adapter with the two IDCs respectively mounted on opposite sides of the circuit board to keep the balance of the adapter even when the tool is implemented to communicate the terminals on the IDCs to the circuit.

Another objective of the invention is that the two IDCs each has a structure the same as that of the other so that the manufacturer is able to save the space for storage and cost for making different spare parts.

Still, another objective of the invention is to provide the circuit board laterally and centrally with respect to the housing, such that the adapter is able to maintain its balance.

Other objects, advantages and novel features of the invention will become more apparent from the following detailed description when taken in conjunction with the accompanying drawings.

DETAILED DESCRIPTION OF PREFERRED EMBODIMENT

Figure 1:
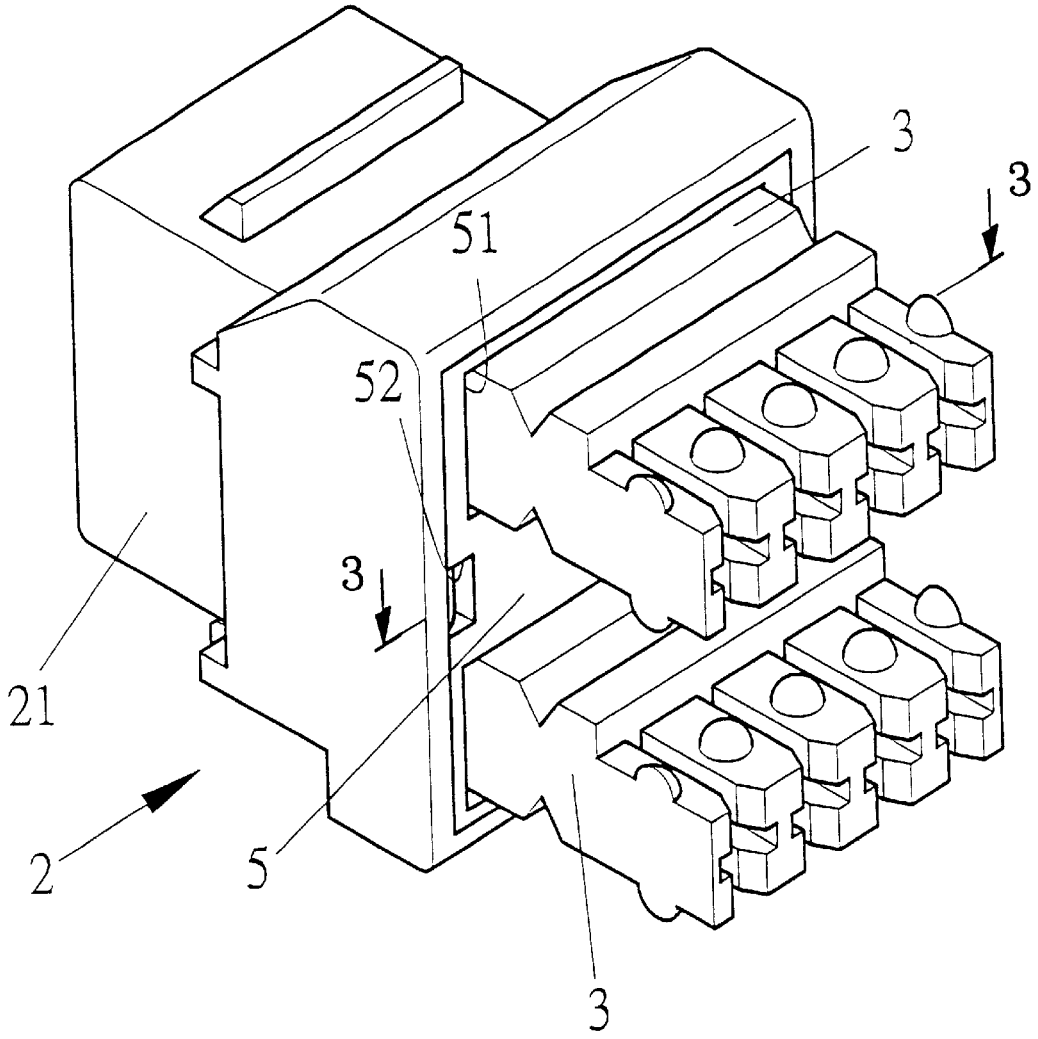
FIG. 1 is a perspective view of the adapter constructed in accordance with the present invention.
Figure 2:
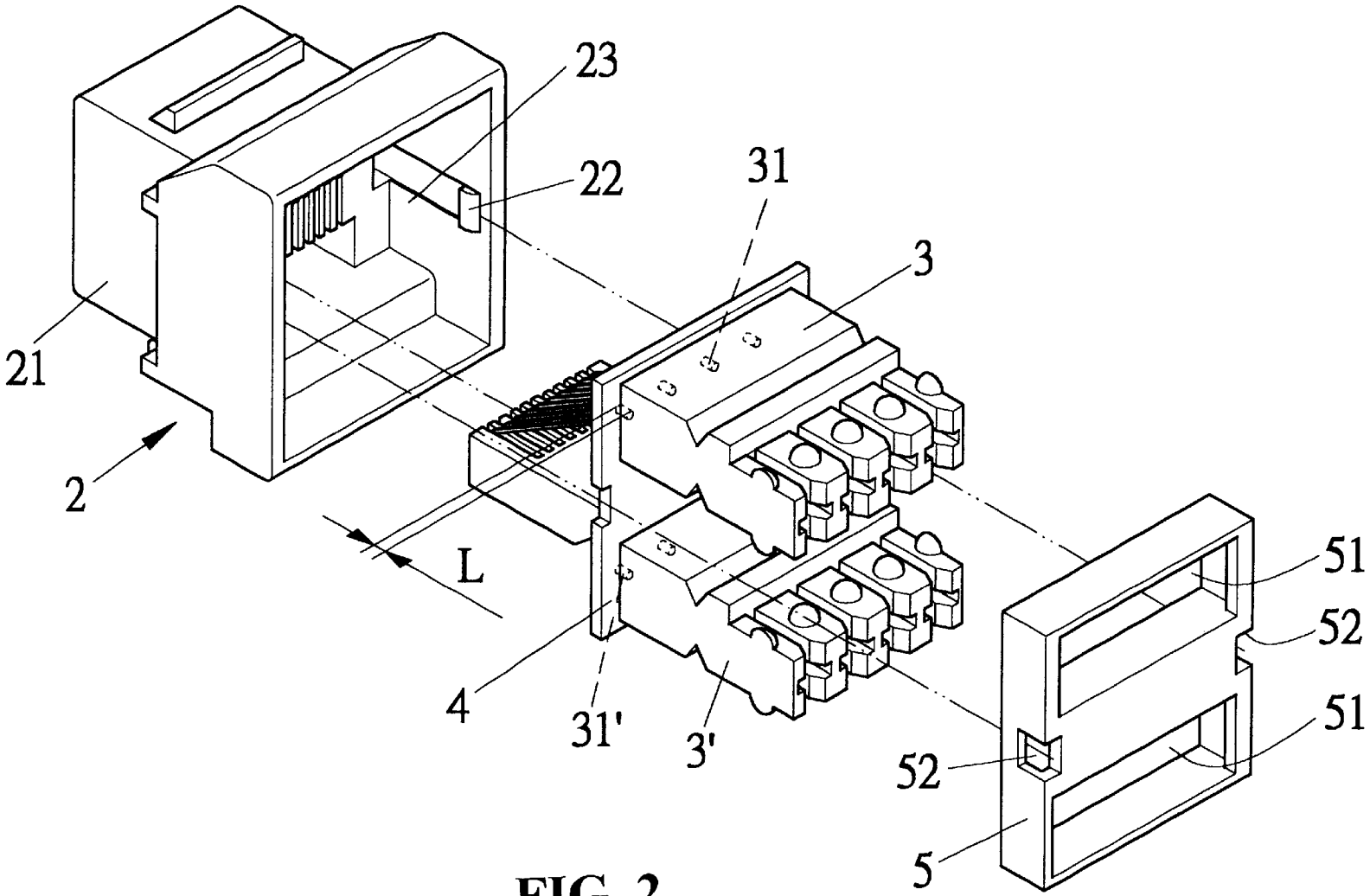
FIG. 2 is an exploded perspective view of the adapter of FIG. 1.
Figure 3:
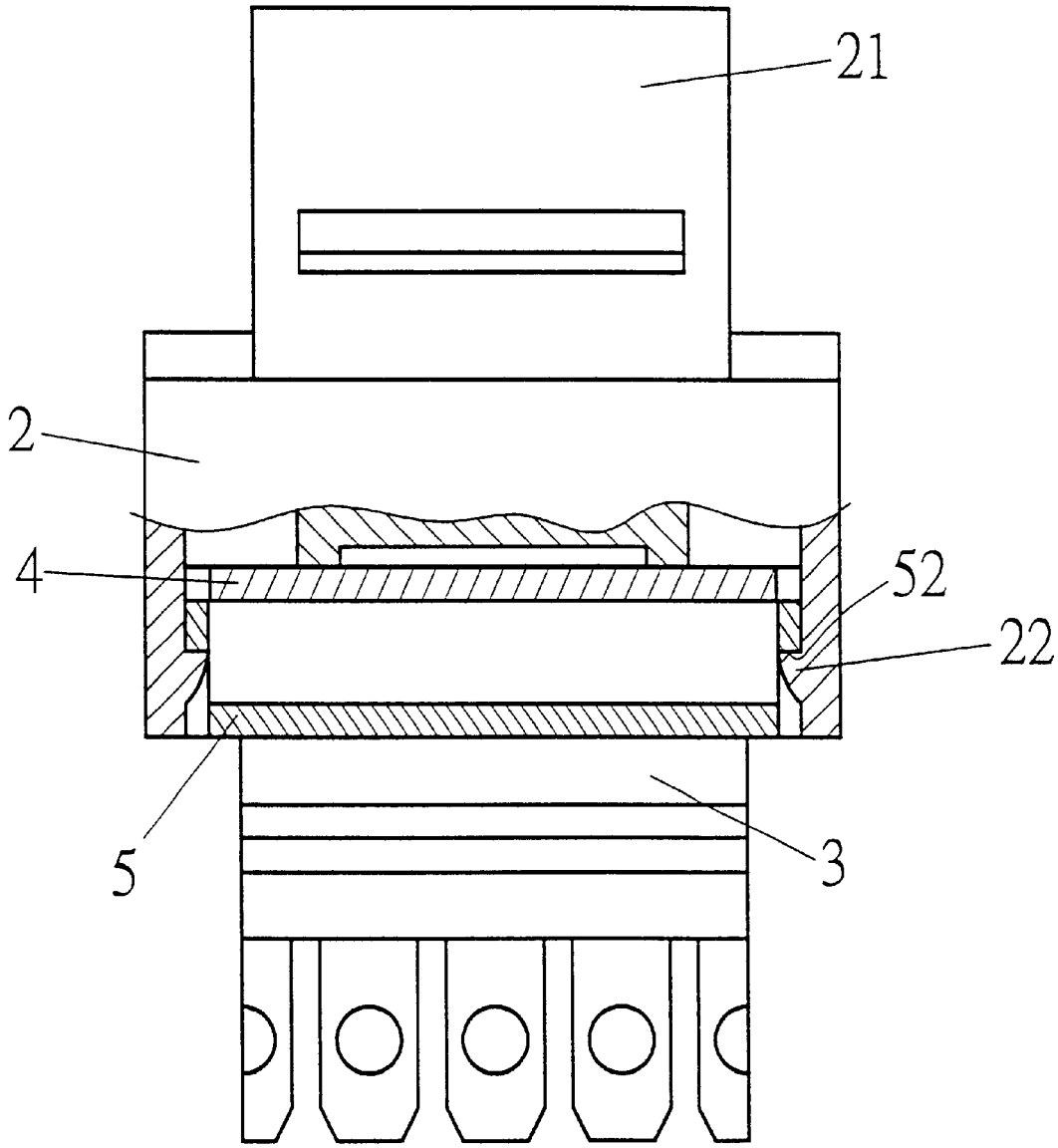
FIG. 3 is a cross sectional view of the adapter of FIG. 1 taking the line 3—3.
Figure 4:
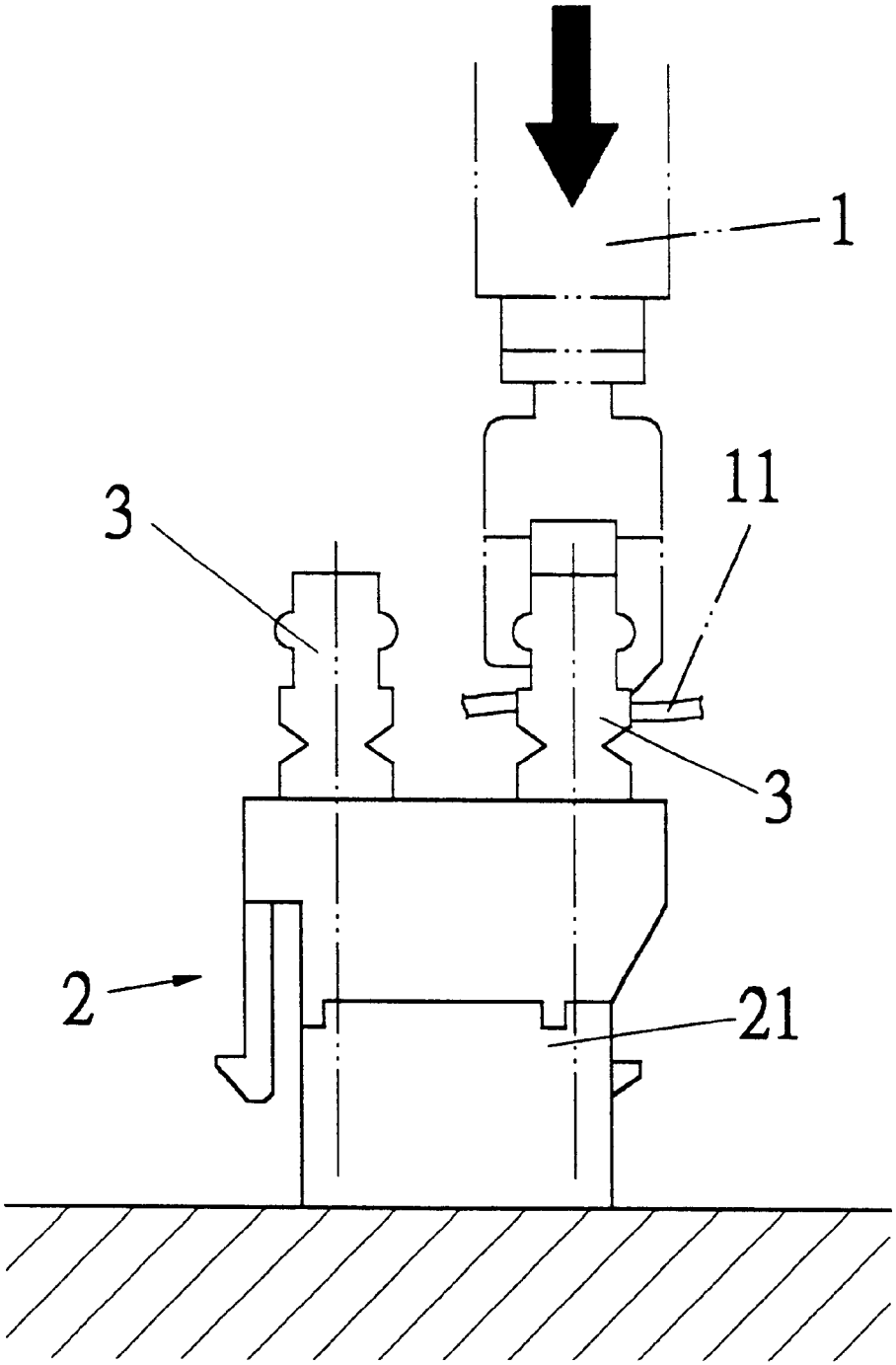
FIG. 4 is a schematic view showing the communication of the adapter.
Figure 5:
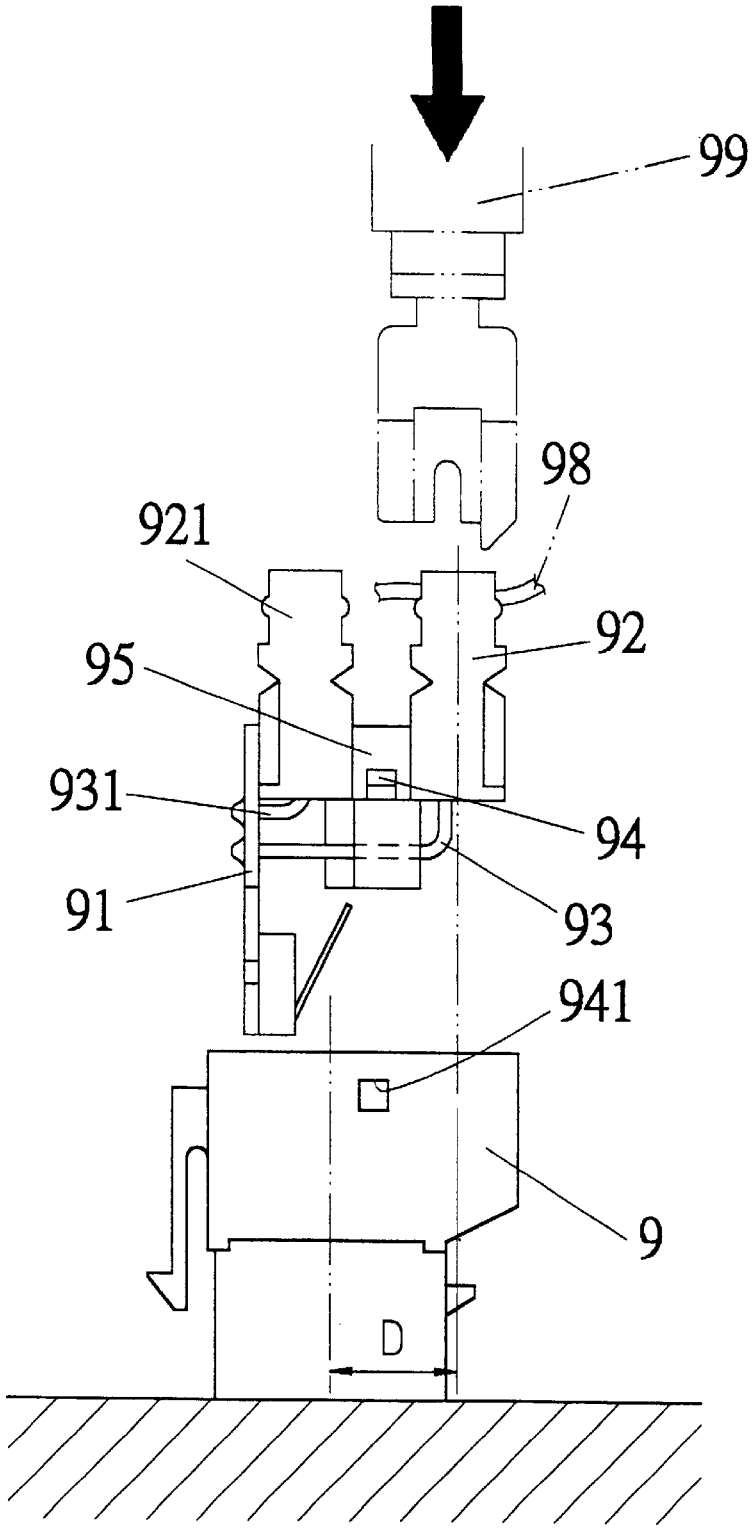
FIG. 5 (Prior Art)
FIG. 5 is a schematic view of the communication of a conventional adapter.
Figure 6:
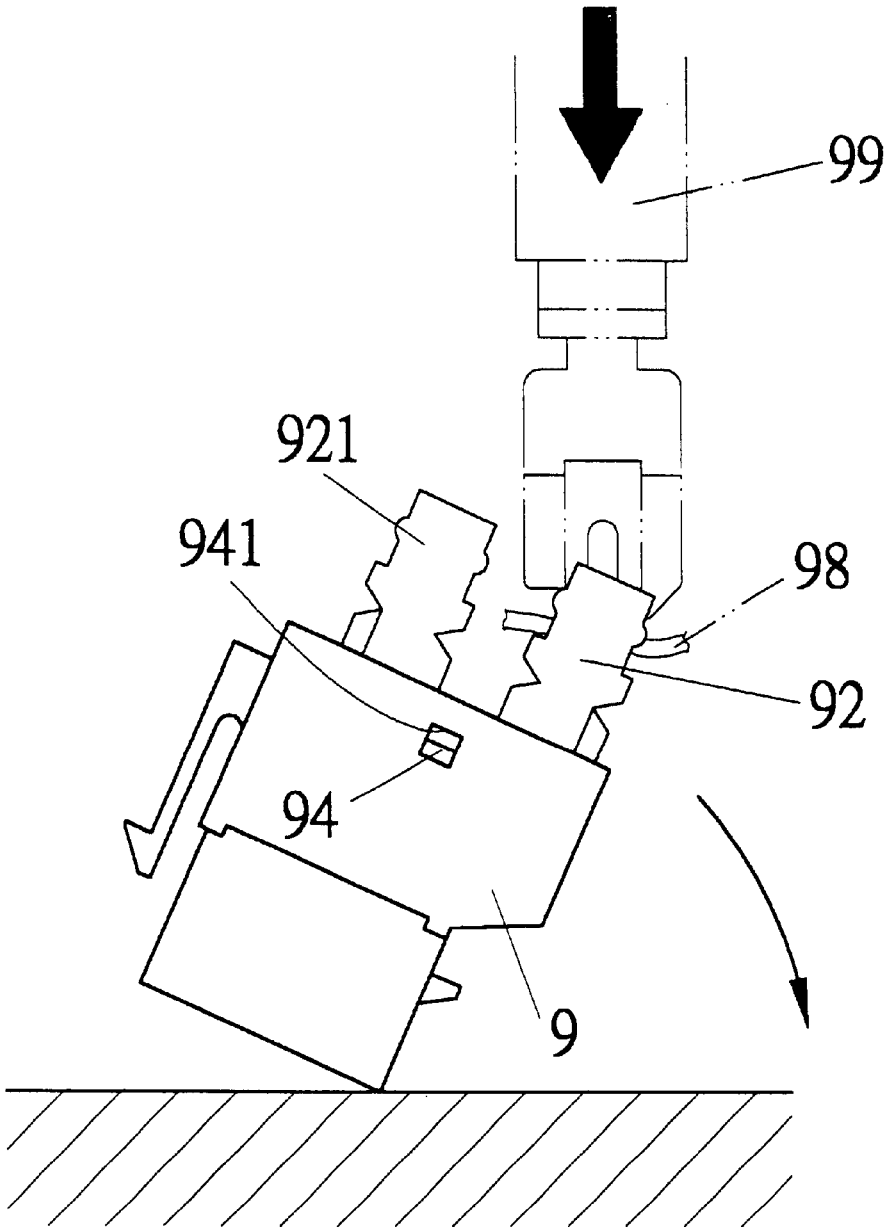
FIG. 6 (Prior Art)
FIG. 6 is a schematic view of the conventional adapter, wherein the adapter is falling to a side when a tool is implemented to make the communication between the terminals and the circuit board.

With reference to FIGS. 1 and 2, an IDC adapter in accordance with the present invention has a housing (2), a first IDC (3), a second IDC (3'), a circuit board (4) and a cover (5).

The housing (2) is hollow and has a socket (21) on a side, an open end (23) and two first retainers (22) respectively formed on opposite inner side walls of the hollow housing (2).

The first and the second IDCs (3,3') are securely mounted on the circuit board (4) and are vertical with respect to the circuit board (4). Each of the first and second IDCs (3,3') has multiple terminals (31,31') securely formed thereon. The first and the second IDCs (3,3') are so received in the housing (2) that a tool (1) is able to be provided to puncture wires (11) to communicate with the terminals (31,31').

The cover (5) has two through holes (51,51') defined to correspond to each of the first and second IDCs (3,3') so as that the first and the second IDCs (3,3') are able to respectively extend through a corresponding one of the through holes (51,51'), and two second retainers (52) respectively formed on opposite sides of the cover (5) to correspond to the first retainers (22). In this preferred embodiment of the present invention, the first retainers (22) are hooks and the second retainers (52) are notches, such that the hooks are able to hook sides defining the notches respectively.

In assembly, the two IDCs (3,3') are securely and vertically mounted on the circuit board, (4). After the IDCs (3,3') and the circuit board (4) are received inside the housing (2), the cover (5) is provided to enclose the IDCs (3,3') together with the circuit board (4) inside the housing (2). Meanwhile, the first retainers (22) and the second retainers (52) are securely engaged with each other. That is, the hooks (22) are securely engaged with the notches (52). It is noted that when the cover (5) is provided to enclose the IDCs (3,3') and the circuit board (4) inside the housing (2), a rear portion of each of the IDCs (3,3') extends through a corresponding one of the through holes (51,51') of the cover (5).

Because the first and the second IDCs (3,3') are respectively vertical with respect to the circuit board (4), each of the terminals (31,3 I') has a length shorter than that of the conventional terminals as described earlier. Further, there is no need for the positioning seat to secure the two IDCs (3,3'), such that the two IDCs (3,3') are identical in not only the configuration, but also the size. With such an arrangement, the center of gravity of the assembled adapter still falls within an area covered by the housing (2), so that when the tool (1) is applied to puncture the wires (11), the adapter of the invention can still stand firmly.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An insulation displacement connector type adapter comprising:

a hollow housing having a socket on a side, an open end and two first retainers respectively formed on opposite inner side walls of the hollow housing;

a circuit board securely enclosed inside the housing;

a first and a second IDCs securely mounted on the circuit board and being vertical with respect to the circuit board, wherein each of the first and second IDCs has multiple terminals securely formed thereon to communicate with the circuit board; and a cover engaged with the housing to cover the open end and having two through holes defined to correspond to each of the first and second IDCs so as that the first and the second IDCs are able to respectively extend through a corresponding one of the through holes, and two second retainers respectively formed on opposite sides of the cover to correspond to the first retainers.

2. The IDC adapter as claimed in claim 1, wherein the each of the first retainers are hooks and each of the second retainers are notches, such that the housing and the cover are able to securely engaged with each other.

3. The IDC adapter as claimed in claim 1, wherein a center of gravity of the adapter falls within an area covered by the housing.

4. The IDC adapter as claimed in claim 1, wherein each of the multiple terminals of the first and the second IDCs have a length the same as that of each other.

5. The IDC adapter as claimed in claim 2, wherein a center of gravity of the adapter falls within an area covered by the housing.

6. The IDC adapter as claimed in claim 2, wherein each of the multiple terminals of the first and the second IDCs have a length the same as that of each other.

7. The IDC adapter as claimed in claim 3, wherein each of the multiple terminals of the first and the second IDCs have a length the same as that of each other.

* * * * *